US005690256A

United States Patent [19]

Smith

[11] Patent Number: 5,690,256

[45] Date of Patent: Nov. 25, 1997

[54] AEROSOL VALVE HAVING MECHANISM TO RESET FLOW SHUTOFF IF VALVE IS TIPPED BEYOND A CERTAIN INCLINATION FROM VERTICAL

[75] Inventor: Jeremy P. Smith, Loudon, N.H.

[73] Assignee: Summit Packaging Systems, Inc., Manchester, N.H.

[21] Appl. No.: 642,872

[22] Filed: May 6, 1996

[51] Int. Cl.[6] ..... B65D 83/00

[52] U.S. Cl. ..... 222/402.1; 222/402.25

[58] Field of Search ..... 222/402.1, 402.15, 222/402.14, 402.25

[56] References Cited

U.S. PATENT DOCUMENTS

| | | | |
|---|---|---|---|
| 3,186,605 | 6/1965 | Potoczky . | |
| 3,315,693 | 4/1967 | Braun . | |
| 4,124,149 | 11/1978 | Spitzer et al. . | |
| 4,440,325 | 4/1984 | Treuhaft et al. | 222/402.14 |
| 4,669,273 | 6/1987 | Fischer et al. . | |
| 4,940,170 | 7/1990 | Popp-Ginsbach . | |
| 5,186,201 | 2/1993 | Warren . | |
| 5,348,199 | 9/1994 | Smith . | |

FOREIGN PATENT DOCUMENTS

| | | | |
|---|---|---|---|
| 526 298 | 2/1993 | European Pat. Off. . | |
| 80/02829 | 12/1980 | WIPO | 222/402.14 |

*Primary Examiner*—Gregory L. Huson
*Attorney, Agent, or Firm*—Davis and Bujold

[57] ABSTRACT

In an aerosol valve which includes a flow path with a compartment having an inlet into the compartment and a valve seat at the upper end of the compartment, a pocket is disposed downward from the seat opening, the pocket contains a gravity-responsive ball. When the valve is being used during dispensing and is tipped in a direction which brings the ball closer to the flow through the compartment, the ball becomes entrained in the fluid flow and flies up to seat on the valve seat to block it off, precluding further discharge. When the aerosol valve is further depressed, the ball will be forced away from the seat to again open the discharge path. The purpose of the valve is to avoid the escape of propellant or product which might occur in tipping if the lower end of the dip tube is exposed to the head space.

20 Claims, 4 Drawing Sheets

AEROSOL VALVE HAVING MECHANISM TO RESET FLOW SHUTOFF IF VALVE IS TIPPED BEYOND A CERTAIN INCLINATION FROM VERTICAL

FIELD OF THE INVENTION

This invention relates to a pressurized valve, such as an aerosol valve, having means to automatically shutoff the discharge flow of product content, from the container, when the container is tipped or knocked over and means for reopening the discharge flow path, as desired, when the valve is again properly orientated.

BACKGROUND OF THE INVENTION

There has always been a need to shutoff a discharging flow when an aerosol container is tipped or knocked over, and this need is even greater now. With the environmentally mandated prohibition of chloroflorocarbons and hydrocarbons propellants, the aerosol industry has turned to pressurized gas propellants, especially nitrogen and carbon dioxide. Nitrogen and other pressurized gases, having relatively high vapor pressure, are not as ideal as some chloroflorocarbons or hydrocarbons because they do not change from a liquid phase to a gaseous phase and permit the pressure to recover as part of the propellant is used up or lost. Nitrogen and carbon dioxide do not transform into a liquid phase at the practical pressures used in aerosol containers.

To permit the tilting of the container during dispensing runs the risk of the bottom of the dip tube being exposed to the head space above the product liquid which would let the pressurized gas above the product escape. Any such escape cannot be tolerated in a compressed gas system.

The closest known prior art is believed to be U.S. Pat. No. 5,348,199 issued to Smith on Sep. 20, 1994. That citation shows a shutoff mechanism which is activated when the container is sufficiently tilted or tipped over and a bypass arrangement which allows the pressure in the valve to rise slowly in order to release a ball which has disrupted the product flow through the valve. The bypass arrangement of Smith takes a relatively long time to equalize the pressure in the valve so that the ball may fall away from the valve seat under the force of gravity.

While the aerosol valve art is extensive, there is currently is not any satisfactory answer to the problem of manually resetting a valve quickly, once a shutoff mechanism has been engaged to disrupt the flow of the container contents through the valve, after the valve has been again properly orientated.

SUMMARY OF THE INVENTION

Wherefore, it is an object of the present invention to overcome the aforementioned problems and drawbacks associated with the prior art designs.

The present invention is concerned with means for shutting off the flow of aerosol whenever a container, incorporating the valve, is tilted to a point at which the bottom of the dip tube is exposed or is in danger of being exposed to the head space, and a mechanism for manually reopening the discharge flow path as desired.

In the present invention, a more or less standard aerosol valve comprises a cup-shaped body with a valve therein, the body having at its lower end an inlet passage and an outlet passage in the opposite end thereof. This structure constitutes a flow path into the valve body through the inlet passage and out of the valve body through the valve stem and outlet passage when the stem is depressed. The valve also encloses a tubular stem extension which is located proximate the flow interrupt ball and positioned to engage the ball, during an overstroke of the valve stem, and positively unseat the ball from the ball seat to reset the flow shutoff mechanism.

During use, when the aerosol valve is turned on, or is already on, and the container is tipped in a direction which brings the ball close to the steam of product flow through the compartment, the ball becomes entrained in the product flowing through the inlet passage and flies and seats against on the valve seat to block it off, thereby precluding further product discharge.

The invention also includes a manual mechanism, once the aerosol valve is shutoff, for unseating the ball by use of the valve stem so that ball is positively unseated from the seat to facilitate further product discharge through the valve.

The invention further includes an overcap/actuator which allows the valve stem of the valve, when the valve is installed on a pressurized container, to be continuously held in a discharge position while also allowing the ball to be manually unseated once the flow has been shut off.

In particular, the invention also relates an aerosol valve comprising a valve body having a product inlet; a valve element being accommodate by said valve body and having a valve stem extending out from said valve body, and said valve element including a product outlet; spring means being compressively disposed between said valve element and said valve body for urging said valve element into a normally closed position for preventing the flow of product through said valve; a product flow path for product being defined through said valve and interconnecting said product inlet with said product outlet; a dip tube being connected to said product inlet of said valve body; and a flow shutoff mechanism being formed along the product flow path, said flow shutoff mechanism having a first position which permits the flow of product past said flow shutoff mechanism and a second position which prevents the flow of product therethrough; the improvement wherein said valve element, upon further actuation thereof against the bias of said spring means, engages with said flow shutoff mechanism to bias said flow shutoff mechanism from the first position into the second position to reset said flow shutoff mechanism and again allow the flow of product past said flow shutoff mechanism.

BRIEF DESCRIPTION OF THE DRAWINGS

Further objects and features of the invention will be apparent from the following specification and a study of the accompanying drawings, all of which disclose non-limiting embodiments of the invention. In the drawings.

DESCRIPTION OF THE PREFERRED EMBODIMENT

Figure 1:
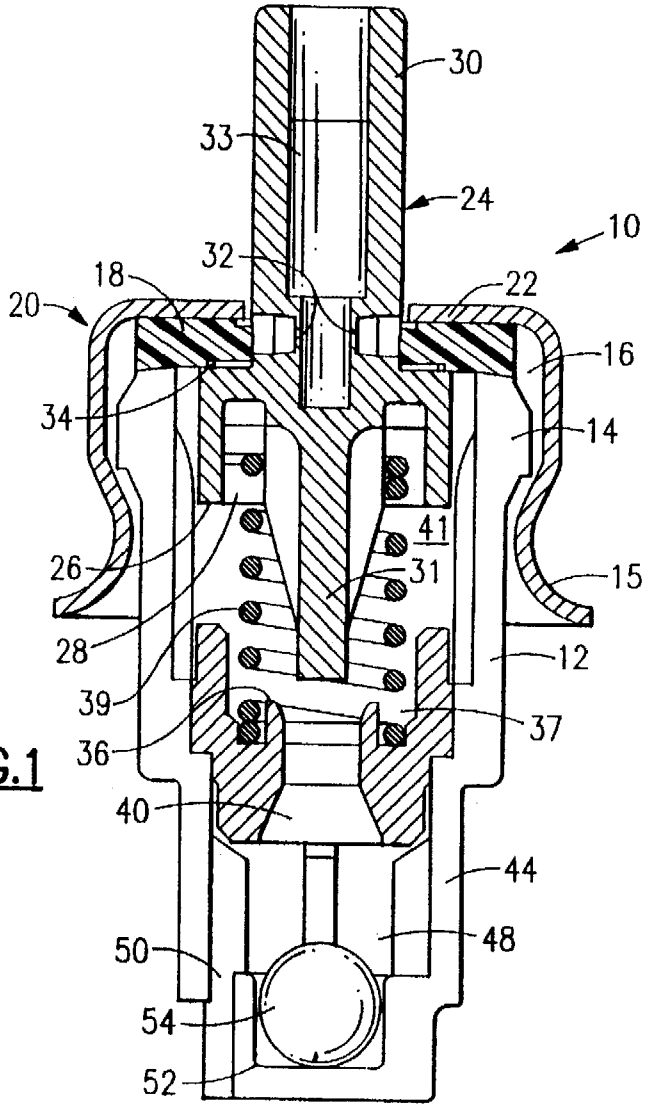
FIG. 1 is a diagrammatic cross-sectional view of an aerosol valve embodying the invention.

An aerosol valve embodying the invention is generally designated as 10 in FIG. 1. It comprises a generally cylindrical valve body 12 thickened outwardly at its upper end 14 and having the usual filling castellations 16 outward therefrom. An annular gasket 18 is disposed across the top of the valve body 12 centered by the inner margins of the castellations 16. The conventional mounting cup pedestal 20, which has a flat top at 22, is crimped over the thickened upper end 14, forming annular groove 15, to secure the valve body 12 and gasket 18 in place.

A valve element 24, comprising an enlarged head 26 having an annular opening or recess 28 formed in the bottom surface thereof, has a first upward extending hollow tubular stem (stem extension) 30 as well as an opposed second downward extending solid tubular stem 31, and generally radial ducts 32 extend outward from the inside of the upward hollow tubular stem 30 and are closed off by the snug fitting resilient gasket 18. Upwardly extending hollow tubular stem 30 contains discharge product outlet 33 which facilitates discharge of the product content out through the valve stem preferably to a spray button or an overcap (not shown), or directly into the environment.

As shown, the upper end of the head 26 carries an annular sealing ring or ridge 34 which engages the underside of the gasket 18 to further seal the valve. The cylindrical valve body 12 has an integral floor 36 formed centrally with a product flow passage 40 leading into a cavity 41 formed in an upper portion of the valve body 12, and an annular opening or recess 37 is formed in floor 36 and faces the bottom surface of head 26. A spring 39 is compressively disposed between annular opening or recess 37 in floor 36 and annular opening or recess 28 in valve element 24, urging valve element 24 upward to seat against gasket 18. As shown, product flow passage 40 may be chamfered at its lower end to form a ball valve seat.

Figure 6:
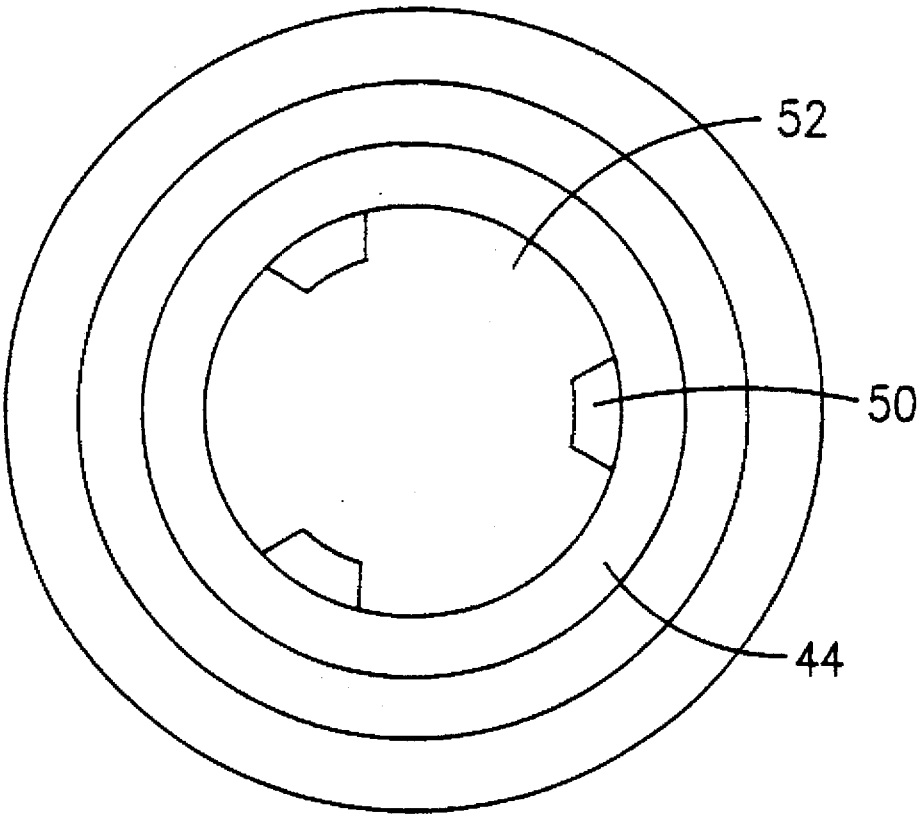
FIG. 6 is a diagrammatic bottom end view of valve of FIG. 1, without the mounting cup.

Sidewall 44, formed at a lower end of valve body 12, defines therein a compartment 48. One or more product passage(s) or inlet(s) 50 is formed in the lower end of valve body 12 and extends upward to pass by the exterior of a pocket 52, extending from sidewall 44, in which is disposed a gravity-responsive ball 54. Product inlet(s) 50 communicates with product flow passage 40 to supply product to the remainder of valve body 12. As can be seen in FIG. 6, in this embodiment there are three equally spaced product inlets 50 provided in sidewall 44 to ensure that the shutoff action, in this embodiment, occurs at the prescribed angle regardless of the direction in which the valve is tipped.

Figure 2:
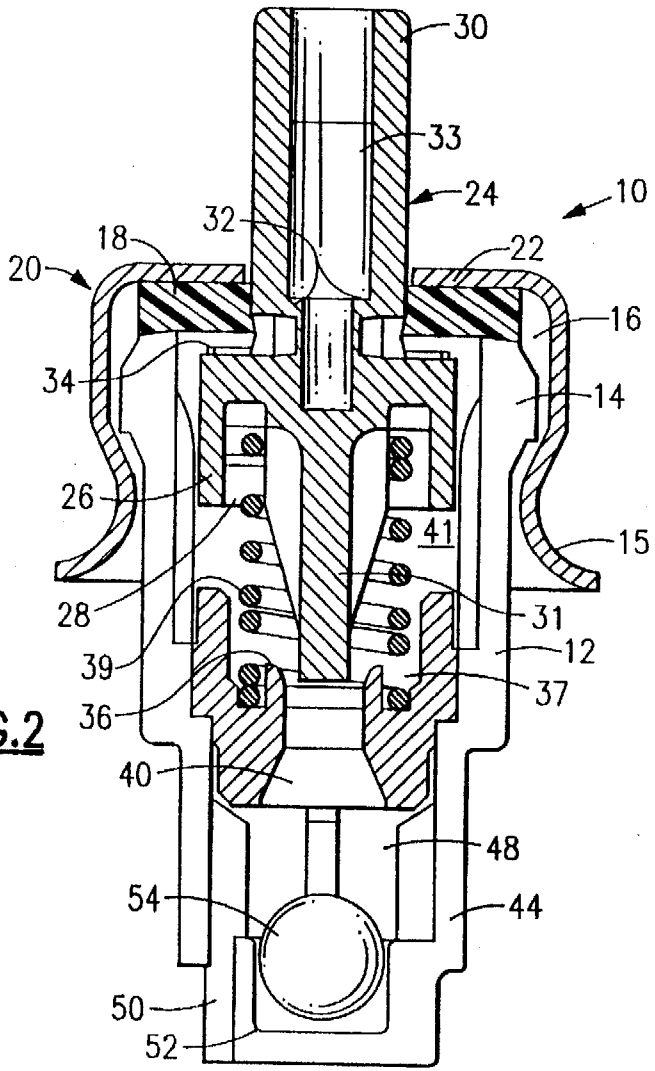
FIG. 2 is a diagrammatic cross-sectional view of the aerosol valve of FIG. 1 showing the valve stem depressed into a discharge mode.

FIG. 2 shows the valve 10 in a discharge mode. Valve element 24 is sufficiently depressed such that the product contents of the container are discharged via product inlet 50, product flow passage 40, cavity 41, radial ducts 32 and through product outlet 33, of upward tubular stem 30, into the surrounding environment, preferably through a spray button or overcap (not shown).

Figure 3:
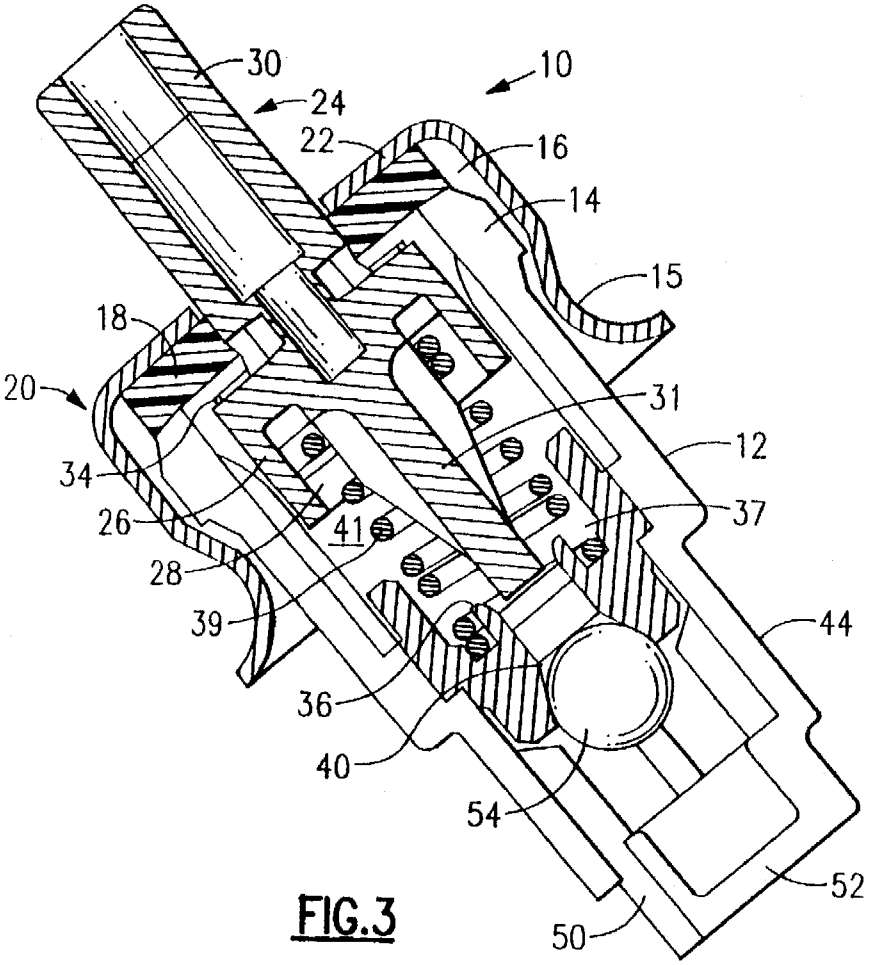
FIG. 3 is a diagrammatic cross-sectional view of the aerosol valve of FIG. 2 with the valve being tipped beyond an operative range of inclination so that the shutoff by the ball has occurred.

FIG. 3 shows the valve 10 of FIG. 2 tipped at an angle of about 45°. At this point, with the valve element 24 depressed so that the product contents of the container can otherwise discharge, the ball 54 moves from the base of its pocket toward the product flowing through inlet 50 such that the ball becomes entrained in the product fluid stream and is carried up to and seats against the chamfered product flow passage 40, cutting or shutting off further product flow.

The angle at which the valve 10 must tilt before the ball 54 is conveyed to block the product flow passage 40 depends on a number of factors, such as the flow rate of fluid along the fluid path, the nature of the fluid passing—whether the fluid is a thin liquid such as perfume or a heavier substance such as furniture polish—, the weight and size of the ball 54, etc. The ball 54, for instance, may be a steel ball having a diameter of ⅛ inch and a specific gravity of 8, or a plastic ball having a specific gravity of 1.3. The lighter the ball 54, the quicker it will fly up and block off product flow passage 40 when the valve is tipped or inclined.

By experimenting with different flow rates of product and different gravity-responsive balls, the ball can be selected to fly up when the valve is tipped to a desired angle or, ideally, only after the product has discontinued its upward movement and is followed by the pressurized gas propellant in the head space. It is, of course, desirable in that discharge of product solely is the ultimate aim of an aerosol valve and flow through the valve should only be interrupted when there is actual discharge of gas.

If it is necessary only to assure that no gas discharges, a convenient angle beyond which the container cannot be tipped without having the ball block the product flow passage 40 is 45°. Product flow, dictated by viscosity, will influence the exact angle at which the valve 10 is tipped prior to valve shutoff occurring.

It will be understood that the shutoff action at the prescribed angle may also be influenced by the direction in which the valve and the container are tipped and the number and location of the product passages or inlets. This may be assured by proper orientation of an overcap, including an actuator button, the overcap being such that the tendency is to operate with the index finger and tilt the container in the same direction as the index finger points. If the container and valve are tipped in a different direction from that shown in FIG. 3, the shutoff still will work but at a slightly greater angle of tip than the prescribed angle.

Figure 4:
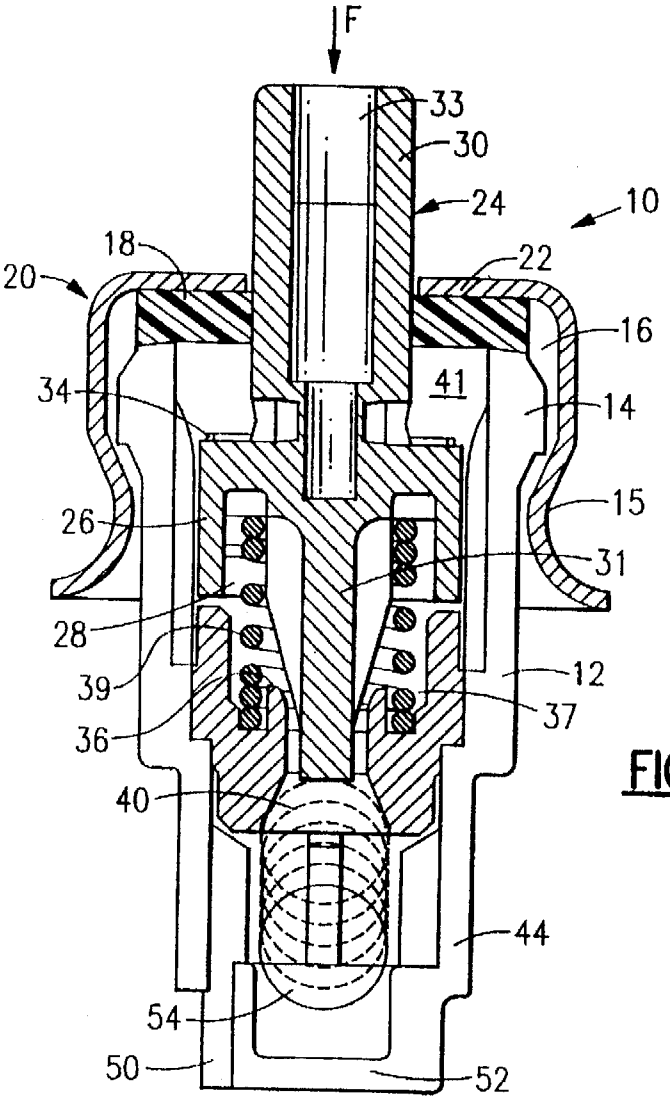
FIG. 4 is a diagrammatic cross-sectional view of the aerosol valve of FIG. 3 showing the valve stem being depressed further, once the valve is reoriented to its original vertical position, in order to reset the shutoff mechanism.

FIG. 4 shows the valve 10 of FIG. 3 again oriented in its original vertical orientation so that the shutoff mechanism can be manually released. This is achieved by further depression of valve element 24, in the direction of arrow F, against the bias of spring 39. As valve element 24 is depressed during its overstroke, a tip portion of downward solid tubular stem 31 commences engagement with ball 54. With further depression of valve element 24, during its overstroke, ball 54 is engaged and positively unseated from product flow passage 40 (as shown in dashed and solid lines) and falls back, due to gravitational forces, and is received by pocket 52. Product flow passage 40 is thereby reopened and can now allow additional product to flow once again through valve 10. As soon as the ball 54 is unseated from product flow passage 40, further dispensing of the product contents from the container automatically occurs.

Figure 5:
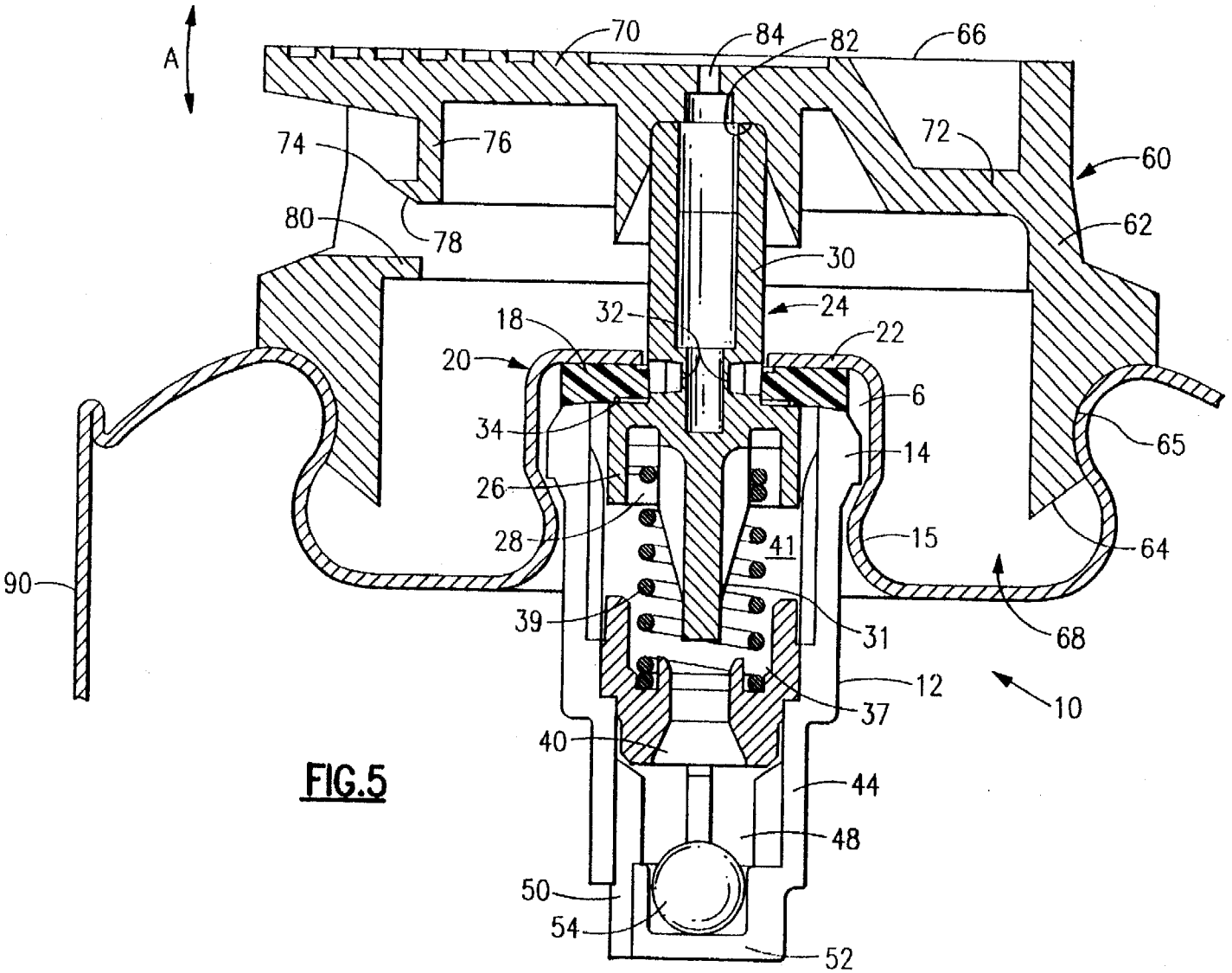
FIG. 5 is a diagrammatic cross-sectional view of the aerosol valve of FIG. 1 showing an arrangement for an overcap/actuator which provides continuously depression of the valve stem while facilitating resetting of the valve following shutoff.

Turning now to FIG. 5, a possible embodiment of an overcap 60 comprises cylindrical side wall 62, bottom wall 64, and top surface 66. Bottom wall 64 has a circular opening 68 formed therein which receives the stem portion of the valve when overcap 60 is placed over valve 10. A radius section 65 of side wall 62 mates preferably with a mounting cup 20, or possibly a rim portion of a container, to secure the overcap 60 to the container 90 (only partially shown).

Top surface 66 has, formed therein, an actuator 70 which is cantilevered at one thereof to an inner portion of side wall 62 by hinge 72 to permit pivoting of actuator 70, in the directions of arrow A, about hinge 72. Adjacent the opposite end of actuator 70 is an downward facing L-shaped latching member which comprises an arm 76 supporting an engaging tab 74 at a remote end thereof. A projection 80 extends radially inwardly from the inner side wall 62 and is located to engage with and lock engaging tab 74 of the L-shaped latching member once actuator 70 is sufficiently pivoted. A lower surface 78 of engaging tab 74 is bevelled or contoured to facilitate engagement between engaging tab 74 and projection 80.

When actuator 70 is sufficiently depressed, the contoured surface 78 abuts against a top surface of projection 80 thereby bending arm 76 and biases engaging tab 74 radially inwardly until engaging tab 74 slides past projection 80. Thereafter, engaging tab 74 moves radially outward, as the arm 76 returns back to its initial position due to its inherent resilience, and actuator 70 is then positively retained in this position by the mating action of engaging tab 74 and projection 80.

A recess 82 is centrally formed in a base of actuator 70 in order to receive an end portion of upward tubular stem 30 of valve element 24 when overcap 60 is mated with valve 10. Recess 82 is provided with an opening 84 to facilitate discharge of product through the overcap 60. Due to this arrangement, as actuator 70 is depressed and pivoted about hinge 72, recess 82 biases tubular stem 30 downward thereby opening the valve 10 and allowing product to flow out through upward tubular stem 30, product outlet 33 and opening 84.

When the flow has been automatically shutoff due to tipping of the valve 10 (FIG. 3), overcap 60 permits manual resetting of valve 10. Arm 76 is of sufficient length to permit further depression of actuator 70 which, in turn, allows the tip portion of downward tubular stem 31 to be brought in direct contact with ball 54. Upon further depression of actuator 70, ball 54 is positively unseated from product flow passage 40, via engagement with tip portion of downward tubular stem 31, thereby unseating ball 54 and restoring product flow through product flow passage 40. Once actuator 70 is released, the action of spring 39 urges valve element 24 and, in turn, actuator 70 upward until engaging tab 74 again engages with projection 80. Engagement between engaging tab 74 and projection 80 maintains the valve element in an open position but prevents further pivoting of actuator 70, in a clockwise direction, about hinge 72.

It is to be appreciated that overcap 60 can be formed from any combination of elements which allows upward tubular stem 30 to be continuously retained in a depressed state in order to allow product to flow through valve 10, but must also allow for further depression of valve element 24, during an overstroke of an actuator of the overcap, so that downward tubular stem 31 can positively unseat ball 54 from product flow passage 40 after automatic shutoff of valve 10 has occurred. A variety of known overcaps would be acceptable for achieving the above indicated objectives and thus a further detailed description concerning the same is not provided herein.

It should be understood that the invention is not limited to the embodiments shown, but the invention is instead defined by the scope of the following claim language, expanded by an extension of the right to exclude as is appropriate under the doctrine of equivalents.

What is claimed is:

1. In an aerosol valve comprising:

a. a valve body having a product inlet;

b. a valve element being captively accommodate by said valve body and having a valve stem extending out from said valve body, and said valve element including a product outlet;

c. spring means being compressively disposed between said valve element and said valve body for urging said valve element into a normally closed position for preventing the flow of product through said valve;

d. a product flow path for product being defined through said valve and interconnecting said product inlet with said product outlet;

e. a dip tube being connected to said product inlet of said valve body; and f. a flow shutoff mechanism being provided along the product flow path, said flow shutoff mechanism having a first position which permits the flow of product past said flow shutoff mechanism and a second position which prevents the flow of product therethrough;

the improvement wherein said valve element includes an extension which, upon further actuation of said valve element against the bias of said spring means, engages with said flow shutoff mechanism to positively move said flow shutoff mechanism from the second position towards the first position and again allow the flow of product past said flow shutoff mechanism.

2. An aerosol valve according to claim 1 wherein said flow shutoff mechanism comprises a product flow passage and a gravity-responsive element cooperating with said product flow passage for engagement with a seat of said product flow passage and preventing the flow of product past said product flow passage.

3. An aerosol valve according to claim 2 wherein said flow shutoff mechanism further comprises a compartment including a generally vertical passage and said gravity-responsive element is located on one side of the vertical passage, said compartment has a first opening adjacent its lower end and an upper generally horizontal wall has a second opening therein, said first and second openings comprises a portion of the product flow path.

4. An aerosol valve according to claim 2 wherein said extension of said valve element is a second downwardly extending tubular stem arranged to engage with said gravity-responsive element, during an overstroke of said valve element, when the ball is seated to block said product flow passage, to move said flow shutoff mechanism towards the first position and again allow the flow of product through said flow shutoff mechanism.

5. An aerosol valve according to claim 4 wherein said seat of said product flow passage includes a chamfered surface and said spring means surrounds said second downwardly extending tubular stem.

6. An aerosol valve according to claim 1 wherein said flow shutoff mechanism further comprises a compartment, located along the product flow path, which is opened at a top and said gravity-responsive element is ball freely movable within said compartment.

7. An aerosol valve according to claim 6 wherein said compartment is fixedly disposed at a lower end of said valve body.

8. An aerosol valve according to claim 6 wherein said compartment is integrally formed as part of a remainder of said valve body.

9. An aerosol valve according to claim 1 used in combination with an overcap arranged to cooperate with said valve element, wherein said overcap, when in an actuation position, maintains said valve element in a continuous product discharge position.

10. An aerosol valve according to claim 1 used in combination with a product container containing a product to be dispensed, wherein said product container includes a sidewall and opposed top and bottom surfaces, and at least a portion of said valve element extends out through said top surface of said product container for actuating said aerosol valve into a continuous product discharge position.

11. In an aerosol valve comprising:

a. a cup-shaped valve body adapted to be installed facing outward in a mouth of an aerosol can;

b. an annular resilient gasket sealingly disposed in the open end of said valve body;

c. a valve stem comprising a tubular element snugly disposed in said gasket and having a lateral opening therein normally closed by said gasket and an enlarged head normally disposed against an underside of said gasket;

d. spring means compressively disposed between said valve element and said valve body urging said valve element with the enlarged head against the underside of said gasket;

e. said valve stem having a discharge passage therein and an outlet orifice;

f. a dip tube operatively connected to said valve body so that said dip tube, said valve body, said lateral openings in said valve stem, and said tubular element constitute a flow path for the product through said valve;

the improvement comprising a flow shutoff mechanism fixed in position with respect to said valve body and disposed along the product flow path and, in a first position, normally permitting flow therethrough, said flow shutoff mechanism including a generally vertical passage with a gravity-responsive element located adjacent the vertical passage, whereby when said aerosol valve is open and said aerosol valve is tipped beyond a certain angle from vertical, said gravity-responsive element becomes entrained in the product flow and moves up to a second position to block off the second opening to shutoff flow of product through said aerosol valve; and said valve includes a second downwardly extending tubular stem arranged to engage with said gravity-responsive element, when seated against said product flow passage, to move said flow shutoff mechanism to the first position and again allow the flow of product through said flow shutoff mechanism.

12. An aerosol valve according to claim 1 wherein, when said valve element is biased in the normally closed position by said spring means, a portion of said valve element engages with a gasket such that said gasket closes said product flow path of said valve and prevents the flow of product therealong.

13. An aerosol valve according to claim 11 wherein said product flow passage includes a chamfered surface and said spring means surrounds said second downwardly extending tubular stem.

14. An aerosol valve according to claim 11 wherein said compartment is fixedly disposed at a lower end of said valve body and said gravity-responsive element is a ball freely movable within said compartment.

15. An aerosol valve according to claim 11 used in combination with an overcap arranged to cooperate with said valve element whereby said overcap, when in an actuation position, maintains said valve element in a continuous product discharge position.

16. An aerosol valve according to claim 11 used in combination with a product container containing a product to be dispensed, said product container includes a sidewall and opposed top and bottom surfaces, and at least a portion of said valve element extends out through said top surface of said product container for actuating said aerosol valve into a continuous product discharge position.

17. In a product container containing an aerosol valve, in which said aerosol valve comprising a valve body having a product inlet; a valve element being captively accommodate by said valve body and having a valve stem extending out from said valve body, and said valve element including a product outlet; spring means being compressively disposed between said valve element and said valve body for urging said valve element into a normally closed position for preventing the flow of product through said valve; a product flow path for product being defined through said valve and interconnecting said product inlet with said product outlet; a dip tube being connected to said product inlet of said valve body; and a flow shutoff mechanism being formed along the product flow path, said flow shutoff mechanism having a first position which permits the flow of product past said flow shutoff mechanism and a second position which prevents the flow of product therethrough; and said product container being sealed with respect to the environment and at least of said portion of said valve element projecting from a top exterior surface of said product container for actuation of said valve;

the improvement wherein said valve element supports an extension which, upon further actuation of said valve element against the bias of said spring means, engages with said flow shutoff mechanism to positively move said flow shutoff mechanism from the second position towards the first position to again allow the flow of product past said flow shutoff mechanism.

18. A container according to claim 17 wherein said flow shutoff mechanism comprises a product flow passage and a gravity-responsive element cooperating with said product flow passage for engagement with a seat of said product flow passage and preventing the flow of product past said product flow passage.

19. A container according to claim 17 used in combination with an overcap arranged to cooperate with said valve element wherein said overcap, when in an actuation position, maintains said valve element in a continuous product discharge position.

20. A container according to claim 17 wherein said extension of said valve element is a second downwardly extending tubular stem arranged to engage with said gravity-responsive element, during an overstroke of said valve element, when the ball is seated against said product flow passage, to reset said flow shutoff mechanism to the first position and again allow the flow of product through said flow shutoff mechanism.

* * * * *